US012807358B2

(12) United States Patent
Mierig

(10) Patent No.: US 12,807,358 B2
(45) Date of Patent: Nov. 24, 2026

(54) METHOD AND DEVICE FOR CLOSING PACKAGING BAGS WITH ADHESIVE AND PACKAGING

(71) Applicant: Ilke Mierig, Hamburg (CH)

(72) Inventor: Ilke Mierig, Hamburg (CH)

( * ) Notice: Subject to any disclaimer, the term of this patent is extended or adjusted under 35 U.S.C. 154(b) by 0 days.

(21) Appl. No.: 19/253,138

(22) Filed: Jun. 27, 2025

(65) Prior Publication Data

US 2026/0008574 A1 Jan. 8, 2026

(30) Foreign Application Priority Data

Jul. 4, 2024 (DE) ..... 10 2024 119 005.1

(51) Int. Cl.

| | |
|---|---|
| ***B65B 51/00*** | (2006.01) |
| ***B65B 7/02*** | (2006.01) |
| ***B65B 51/02*** | (2006.01) |
| ***B65B 51/06*** | (2006.01) |
| ***B65B 51/10*** | (2006.01) |

(52) U.S. Cl.

CPC ..... *B65B 51/02* (2013.01); *B65B 7/02* (2013.01); *B65B 51/062* (2013.01); *B65B 51/10* (2013.01)

(58) Field of Classification Search

CPC B65B 51/02; B65B 7/02; B65B 5/062; B65B 51/10; B65B 1/188; B65B 9/20; B65B 9/213; B65B 9/2042; B65B 9/22; B65B 61/06; B65B 51/303

USPC ... 53/376.3, 451, 551, 456, 131.5, 410, 411, 53/459, 469, 552

See application file for complete search history.

(56) References Cited

U.S. PATENT DOCUMENTS

| | | | | |
|---|---|---|---|---|
| 4,292,033 A * | 9/1981 | Wolske | ..... | B65D 33/001 493/347 |
| 8,475,046 B2 * | 7/2013 | Jansen | ..... | B65D 33/18 383/88 |
| 10,815,034 B2 * | 10/2020 | Johnson | ..... | B65D 33/08 |
| 12,258,167 B2 | 3/2025 | Czepluch | | |

FOREIGN PATENT DOCUMENTS

DE 102019111657 A1 11/2020

* cited by examiner

*Primary Examiner* — Jacob A Smith

(74) *Attorney, Agent, or Firm* — LUCAS & MERCANTI, LLP; Klaus P. Stoffel

(57) ABSTRACT

A method and a device for closing packaging bags with the aid of adhesive and to a packaging. The packaging bags are sealed with the aid of adhesive, the material of the packaging bag being at least almost completely penetrated by the adhesive in the sealing area.

6 Claims, 1 Drawing Sheet

METHOD AND DEVICE FOR CLOSING PACKAGING BAGS WITH ADHESIVE AND PACKAGING

CROSS-REFERENCE TO RELATED APPLICATIONS

The present application claims priority of DE 10 2024 119 005.1, filed Jul. 4, 2024, the priority of this application is hereby claimed, and this application is incorporated herein by reference.

BACKGROUND OF THE INVENTION

The invention relates to a method for closing packaging bags, in particular mesh bags, with the aid of adhesive.

The invention also relates to a device for closing packaging bags, in particular mesh bags, using adhesive.

The invention also relates to packaging, in particular in the sense of a packaging bag.

Various products, especially fruit and vegetables, are packaged for retail in bags made of mesh or fabric. These bags are usually made from a tubular packaging material and are therefore also called tubular bags.

These packaging bags are often made of plastic, but they are also known to be made of natural fibers such as cellulose or cotton.

Packaging bags made of natural fibers are usually closed with metal clips when products are packaged by machine, as the thermal welding known from DE 10 2019 111 657 A1, for example, and used for plastics to produce a bag closure with sufficient mechanical strength does not work or the use of plastics is not desirable.

In addition, the high temperature during thermal weld sealing of the fibers may cause unwanted weakening of individual fibers in a packaging mesh.

SUMMARY AND DESCRIPTION OF THE INVENTION

It is therefore an object of the invention to provide a device for closing packaging bags which at least partially solves the mentioned problems.

According to the invention, this object is achieved by a device for closing packaging bags, wherein the device is designed to close the packaging bag with adhesive and a metal-free closure strip. The material of the packaging bag is at least almost completely penetrated by the adhesive in the closure region.

It is a further object of the invention to create a method for closing packaging bags which at least partially solves the mentioned problems.

According to the invention, this object is achieved by a method for closing packaging bags in which the packaging bag is wrapped with at least one metal-free closure tape strip in the closure region during closure. The closure of the packaging bag is realized with the aid of adhesive whereby the packaging bag is at least almost completely penetrated by the adhesive in the closure region.

Furthermore, it is an object of the invention to create a packaging that at least partially solves the mentioned problems.

According to the invention, this object is achieved by a packaging designed as a packaging bag made of a mesh or woven material and having a closure realized by the aid of adhesive and a metal-free closure tape strip. The material of the packaging bag is at least almost completely penetrated by the adhesive in the closure region.

The following disclosed features of a device for closing packaging bags, a method for closing packaging bags and a packaging are part of the invention in all practicable combinations.

Figure 1:
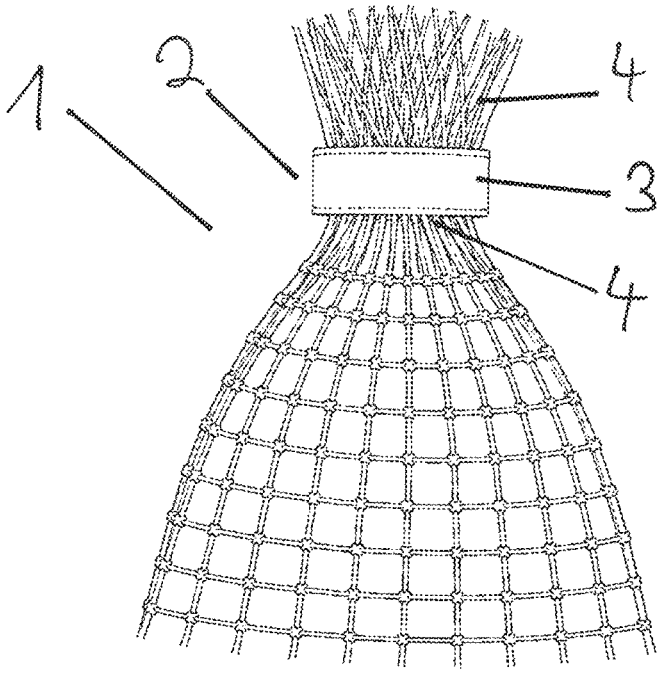
FIG. 1 is a side view of the packaging bag.
Figure 2:
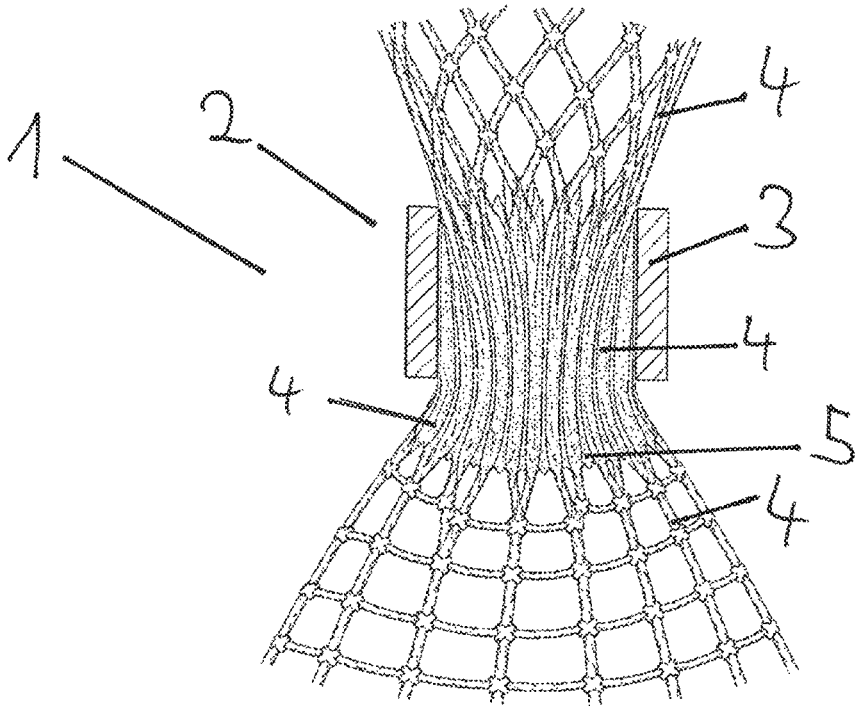
FIG. 2 is a cross-sectional view of the packaging bag in the closure region.

DETAILED DESCRIPTION OF THE INVENTION:

As shown in FIGS. 1 and 2, a packaging bag 1 is made of a mesh or woven material and includes a closure region. In the closure region, a closure 2 is formed by adhesive 5 and a metal-free closure tape strip 3. The metal-free closure tape strip 3 is arranged around the packaging bag 1 in the closure region. The adhesive 5 penetrates the mesh or woven material in the closure region and embeds fibers 4 of the mesh or woven material. FIG.2 shows a cross-sectional view of the packaging bag 1 in the closure region.

According to the invention, the packaging is designed as a packaging bag 1 and is sealed on at least one side using adhesive 5. This makes it possible to avoid the use of a metal clip. In addition, the fibers 4 of the packaging bag 1 are not significantly damaged by the adhesive 5 compared to sealing but retain their structure.

A packaging bag according to the invention is preferably formed from a mesh or woven material.

Preferably, the material of the packaging bag is made entirely or at least essentially from natural fibers, for example cellulose, cotton or linen.

In advantageous embodiments of the invention, the adhesive used to seal the packaging bag is realized as a biological adhesive (bio-adhesive). For example, in embodiments of the invention, sucrose or fructose, starch, protein products and compounds or resins can be used as an adhesive.

In embodiments of the invention, a biological adhesive is a biodegradable adhesive, particularly preferably made from natural materials.

According to the invention, the material of the packaging is completely or at least substantially penetrated by the adhesive in the closure area after completion of the closure. This is important in order to achieve a fixation of all or at least almost all fibers of the packaging in the closure area, so that even internal fibers cannot come loose from the closure. This is to be understood in particular in contrast to the use of known adhesive strips, where the material of the packaging bag only comes into contact with the adhesive superficially and externally in the closure area.

In embodiments of: the invention, the packaging bag 1 is wrapped with a metal-free closure tape strip 3 in the closure area in addition to the adhesive 5. The closure tape strip 3 serves to mechanically stabilize the closure 2 by supporting the fibers 4 of the packaging bag 4 located on the outside in the closure area and to additionally protect the adhesive closure by its shielding function.

In preferred embodiments of the invention, the metal-free closure tape strip is made of natural fibers.

Metal-free in the sense of the invention means that the closure tape strip is not made of metal. However, this includes materials, in particular natural fibers, which may contain traces of metals due to their natural composition.

In embodiments of the invention, the adhesive is applied to at least one side of the closure tape strip and/or the closure tape strip is interspersed with the adhesive.

In a method according to the invention for closing packaging bags made of mesh or fabric, the packaging bag is wrapped with at least one closure tape strip in the closure area.

In a first embodiment of the method, adhesive is applied at least to the side of the closure tape strip facing the material of the packaging bag during sealing. The adhesive can either be applied when the closure tape strip is fed from a supply for sealing the packaging bag or closure tape/closure tape strips already provided with adhesive is/are stored.

Depending on the adhesive used, the closure tape strip is pressed against and/or wrapped around the packaging bag in the sealing area or the adhesive is additionally melted by the effect of heat, so that in all cases the adhesive penetrates the material of the packaging bag in the sealing area and embeds the fibers.

In a second embodiment of the method, closure tape strips are used without previously applied adhesive, wherein, before the closure tape strip is brought together with the packaging bag, adhesive is applied to the packaging bag in the closure area, which adhesive penetrates through the fibers of the packaging bag, if necessary after heating the adhesive.

If an adhesive with thermoplastic properties is used, i.e. an adhesive that melts when heated and solidifies again when it cools, the seal is created after the adhesive has hardened by cooling.

In embodiments of the method according to the invention, two closures are carried out simultaneously to close the upper and lower bag openings.

In embodiments of the method according to the invention, a packaging tube is used for packaging products, wherein the mesh/fabric of the packaging bags is separated from each other between the closures of adjacent packaging bags when the packaging bags are closed.

In embodiments of the method according to the invention, a device for closing packaging bags according to the invention is used.

In embodiments of the method according to the invention, a packaging according to the invention is produced.

In preferred embodiments, the device for closing packaging bags according to the invention is designed to implement the method according to the invention for closing packaging bags.

A packaging according to the invention is designed as a packaging bag and has at least one, usually two, closure areas.

In the production of tubular bags, variants are conceivable in which both sides of the packaging tube are closed together in one closure area, as well as variants in which each tubular bag has a separate lower and upper closure area.

In preferred embodiments of the packaging according to the invention, the packaging tube and the at least one closure tape strip are made of natural fibers.

In particularly preferred embodiments of the packaging according to the invention, the adhesive is also designed as a biological adhesive.

In embodiments of the invention, the closure of the packaging bag is realized by melted adhesive with thermoplastic properties, such as sucrose, fructose or resins.

In embodiments of the invention, the material of the packaging bag is a cellulose mesh.

I claim:

1. A packaging bag made of a mesh or woven material, comprising a closure realized by adhesive and a metal-free closure tape strip, the material of the packaging bag being penetrated by the adhesive in a closure region of the packaging bag so that a fixation of all fibers of the packaging in the closure region of the packaging bag is achieved and even internal fibers cannot come loose from the closure and wherein the packaging bag is wrapped with the metal-free closure tape strip in the closure region of the packaging bag in addition to the adhesive.

2. The packaging bag according to claim 1, wherein the metal-free closure tape strip is made of natural fibers.

3. Packaging bag according to claim 1, wherein packaging tube and the metal-free closure tape strip are made of natural fibers.

4. Packaging bag according to claim 1, wherein the adhesive is a biological adhesive.

5. Packaging bag according to claim 1, wherein the closure of the packaging bag is realized by melted adhesive with thermoplastic properties, such as sucrose, fructose or resins.

6. Packaging bag according to claim 1, wherein the material of the packaging bag is a cellulose mesh.

* * * * *